US007982152B2

(12) United States Patent
Hirose et al.

(10) Patent No.: US 7,982,152 B2
(45) Date of Patent: Jul. 19, 2011

(54) TRIGGER SWITCH

(75) Inventors: Hiroyuki Hirose, Kanagawa (JP); Isao Inagaki, Kanagawa (JP); Satoru Kowaki, Kanagawa (JP)

(73) Assignee: Satori S-Tech Co., Ltd., Tokyo (JP)

( * ) Notice: Subject to any disclaimer, the term of this patent is extended or adjusted under 35 U.S.C. 154(b) by 469 days.

(21) Appl. No.: 12/292,807

(22) Filed: Nov. 26, 2008

(65) Prior Publication Data

US 2009/0139849 A1 Jun. 4, 2009

(30) Foreign Application Priority Data

Nov. 30, 2007 (JP) ..... 2007-310374

(51) Int. Cl.
*H01H 13/02* (2006.01)

(52) U.S. Cl. ..... 200/522; 200/16 C

(58) Field of Classification Search ..... 200/522, 200/332.2, 61.85, 293.1, 43.17, 5 R, 16 R, 200/16 A–16 C, 505, 537, 538, 540, 541
See application file for complete search history.

(56) References Cited

U.S. PATENT DOCUMENTS

| | | | | |
|---|---|---|---|---|
| 4,206,333 | A * | 6/1980 | Savas et al. | 200/5 R |
| 4,282,414 | A * | 8/1981 | Johnston et al. | 200/16 A |
| 5,929,407 | A * | 7/1999 | Ziem | 200/61.89 |
| 6,664,490 | B2 * | 12/2003 | Kato | 200/332.2 |
| 6,749,028 | B1 * | 6/2004 | Chan et al. | 200/16 B |

FOREIGN PATENT DOCUMENTS

JP 2003-162930 6/2003

* cited by examiner

*Primary Examiner* — Felix O Figueroa
(74) *Attorney, Agent, or Firm* — Wenderoth, Lind & Ponack, LLP.

(57) ABSTRACT

Disclosed a trigger switch including fixed contacts forming main contacts double in series and functioning as a switch for supplying a motor with power and slide plate parts connected to the fixed contacts; and movable contacts provided in an actuator interlocking with an operation part and auxiliary contacts sliding on the slide plate parts. Drawing the operation part causes the actuator to move forward making the movable contact come into electric contact with the fixed contact to supply the motor with power, simultaneously making the auxiliary contact bridge over the slide plate parts to achieve electric contact to make no potential in the contact between the movable contact and the fixed contact. Releasing the operation part make the movable contact separate from the fixed contact, simultaneously making the auxiliary contact bridging over the slide plate parts cause a break of the contact with the slide plate part.

7 Claims, 14 Drawing Sheets

TRIGGER SWITCH

BACKGROUND OF THE INVENTION

1. Field of the Invention

The present invention relates to a trigger switch mounted to an electric tool, in detail, a trigger switch comprising a contact mechanism of a spring-reversal type switch suitable for large AC and DC.

2. Prior Art

A conventional trigger switch with a brake contact, which is used for an electric tool, has a structure that an alternate current AC connected to a motor M in series and a switch are provided, as shown in FIG. 18. The switch is arranged so that a movable contact M would be brought into contact with a fixed contact T1 to make a main contact turn on by drawing an operation part provided in the electric tool, and then, the motor M would be supplied with electric power to be rotated although this is not shown in the drawing. Stopping the draw of the operation part causes the main contact to be released from a state of ON. The movable contact M is brought into contact with a fixed contact T2 instead of the above to turn on the brake contact. This causes the motor M to be short-circuited to put on a brake.

As described above, used are the two polar fixed contacts T1 and T2 and the movable contact M wherein one pole is used as a so-called main contact, which is used for supplying the motor M with electric power, and the other pole is used as a so-called brake contact, which causes the motor M to be short-circuited to put on a brake when the motor M is not supplied with electric power (refer to JP-A-2003-162930 (pages 5 to 8 and FIG. 5)).

The switch described in Related Art, however, has a problem that the main contact having a so-called single contact structure is inferior in insulation and life since one of the two polar contacts is used as the main contact while the other is used as the brake contact although the switch has a structure suitable for large AC and DC.

SUMMARY OF THE INVENTION

Accordingly, an object of the invention is to provide a switch mechanism in which plural main contacts are maintained, an auxiliary contact mechanism is used and a brake contact is provided, taking advantage of a contact structure of the auxiliary contact mechanism.

In order to solve the problem, a trigger switch according to the present invention is comprised of: fixed contacts forming main contacts double in series and functioning as a switch for supplying a motor with power and slide plate parts connected to the fixed contacts; and movable contacts provided in an actuator interlocking with an operation part and auxiliary contacts sliding on the slide plate parts, wherein the fixed contacts, the movable contacts and the auxiliary contacts are arranged in a manner that: drawing the operation part causes the actuator to move in a forward direction to make the movable contact come into electric contact with the fixed contact so as to supply the motor with power while simultaneously making the auxiliary contact bridge over the slide plate parts to achieve electric contact so as to make no potential in the contact between the movable contact and the fixed contact, and releasing the operation part causes the actuator to move in a reverse direction to make the movable contact separate from the fixed contact while simultaneously making movement of the auxiliary contact bridging over the slide plate parts cause a break of the contact with the slide plate part and a movable contact provided in the auxiliary contact be in contact with a fixed contact for short-circuiting the motor.

Further, a trigger switch according to the present invention in a spring reverse type switch is comprised of: a pair of fixed contacts arranged to face in a same direction in a box-like case having an opening surface, the fixed contacts forming main contacts double in series; a pair of movable contacts coming into contact with and/or going away from the pair of fixed contacts and an actuator having pressure springs for pressuring the pair of movable contacts from a rear side; a rotatable reverse member for driving the actuator; a coiled reverse spring having one end connected to the reverse member and the other end engaged with a plunger, the reverse spring having a reverse point; and an operation part for moving the plunger, whereby the operation part is pushed/released to make the pair of movable contacts come into contact with/go away from the pair of fixed contacts to turn on/off the main contacts double in series, wherein the actuator includes a pair of auxiliary contacts, a slide plate part connected to one fixed contact of the pair of fixed contacts and a slide plate part connected to the other fixed contact are provided, and the fixed contacts, the movable contacts and the auxiliary contacts are arranged in a manner that; reverse movement of the reverse member causes the pair of movable contacts to come into contact with the pair of fixed contacts and simultaneously causes the pair of auxiliary contacts to bridge over the slide plate part connected to one fixed contact of the pair of the fixed contacts and the slide plate part connected to the other fixed contact to achieve electric contact after the actuator is moved by a fixed amount to reduce an interval between the contacts before the reverse point in turning on the main contacts double in series, and releasing restraint of the actuator after the reverse point causes the pair of movable contacts to go away from the pair of fixed contacts, and simultaneously causes the electric contact achieved by the pair of auxiliary contacts bridging over the slide plate part connected to one fixed contact of the pair of fixed contacts and the slide plate part connected to the other fixed contact to be released and causes the motor to be short-circuited by making a movable contact provided in the slide plate part come into contact with a fixed contact provided on an opposite side so as to be faced to the pair of fixed contacts to achieve electric contact after restraint of movement of the actuator before the reverse point in turning off the main contacts double in series.

A pinion may be formed in the reverse member and a rack engaged with the pinion may be formed in the actuator.

It is preferable that the plunger includes a projection part projecting downward, the reverse member includes a protrusion pressured by the projection part in accordance with a push of the operation part, and pushing down the operation part causes the projection part to pressure the protrusion of the reverse member to make the reverse member rotate against force of the reverse spring and causes the actuator to move to make the movable contact approach a fixed contact.

It is preferable that a surface having a gentle difference in level is formed in a lower surface of the plunger at a top end part thereof, a stopper member having a claw part and constantly contacting with the surface with a difference in level is provided, a stopper spring for urging the stopper member upward is provided, the actuator is provided with a lock part for engaging with the claw part of the stopper member, and movement of the stopper member along the surface with a difference in level of the plunger locks or releases engagement of the claw part of the stopper member with the protrusion of the actuator.

Further, it is preferable that the stopper member is raised in turning on the switch, the lock part of the actuator moves over the claw part of the stopper member to make the movable contact come into contact with the fixed contact, and engagement of the claw part with the lock part of the actuator is locked at the time.

Moreover, it is preferable that moving the operation part in a direction of switching off to move the plunger over the reverse point of the reverse spring in the locked state does not cause a release state for a period of time due to the shape of the lower surface of the plunger at the top end part, further moving the operation part in a direction of switching off over the reverse point of the reverse spring causes the stopper member to go down due to the lower surface of the plunger at the top end part to make the lock means released, and as a result, the actuator immediately moves and the movable contact is instantaneously separated from the fixed contact to switch off.

According to the trigger switch of the invention, a function of a spring reverse type switch fast turning on and fast turning off is utilized to achieve electric conduction of slide plate parts connected to a pair of fixed contacts by means of an auxiliary contact in timing of fast turning on after the reverse point after a movable contact is made sufficiently closely approach a fixed contact before the reverse point of the spring in turning on the switch. This allows the conduction to be achieved with the auxiliary contact having no potential. Accordingly, a state of contact can be well maintained by means of the auxiliary contact even when a change occurs in a state of contact between the movable contact and the fixed contact. As a result, the state of contact between the fixed contact and the movable contact can be well maintained.

In addition, an auxiliary contact is provided with an auxiliary movable contact and the auxiliary movable contact is made contact with auxiliary fixed contacts for short-circuit a motor when the operation part is drawn in order to put on a brake for the motor. This allows main contacts double in series to be used as two poles, and thereby, a switch with a large capacity and a long life to be achieved.

DETAILED DESCRIPTION OF THE PREFERRED EMBODIMENTS

Figure 1:
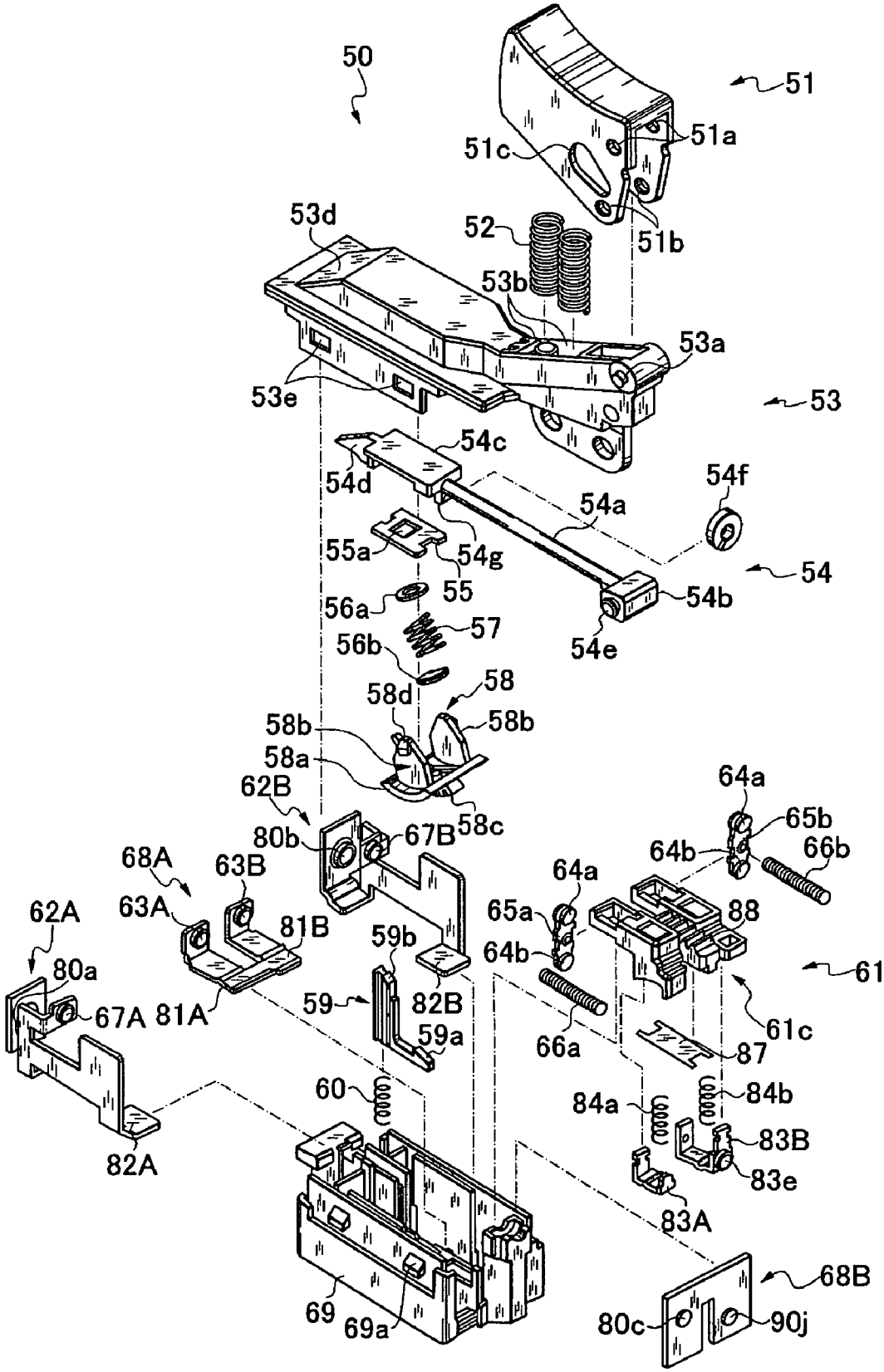
FIG. 1 is an exploded perspective view of a trigger switch according to an embodiment of the invention.

As shown in FIG. 1, a trigger switch 50 according to an embodiment of the invention is provided with an operation part 51 capable of operation by a manual grasp, an actuator 61 operating together with the operation part, a plunger 54 for transmitting a condition of an operation of the operation part 51 to the actuator 61, a reverse member 58 for moving the actuator 61 straight in a direction same as that of rotation and a case 69 formed from an insulating member into a box-like shape having an opening at its top.

The operation part 51 contains two return springs 52 inside. A rear end part of the operation part 51 is pivoted at one end of a cover 53, which holds lower ends of the return springs 52. The other end (a front end side) of the cover 53 contains the plunger 54 and functions as a lid of the case 69. The reverse member 58 is reversed by means of a reverse spring 57 on the basis of a condition of an operation of the operation part 51. A guide plate 55 guides the reverse. At the both ends of the reverse spring 57, provided are two plates 56*a* and 56*b*.

The actuator 61 includes a rack part 61*c*, movable contact pieces 65*a* and 65*b*, movable contacts 64*a* and 64*b*, which are mounted respectively to the movable contact pieces 65*a* and 65*b* and which are four in number in total, pressure springs 66*a* and 66*b* for constantly urging the movable contact pieces 65*a* and 65*b* and auxiliary contact engaging parts 61*d* and 61*e* for interlocking with first and second auxiliary contacts 83A and 83B with the first and second auxiliary contacts 83A and 83B being urged by spring pressure of auxiliary springs 84*a* and 84*b*.

In the case 69, housed are a stopper member 59 for locking the actuator 61 under a condition that the movable contact pieces 65*a* and 65*b* are in contact, a stopper spring 60, first and second terminals 62A and 62B, which are electrically connected to an external part and having two fixed contacts 67A and 67B, a third terminal 68A having two fixed contacts 63A and 63B and a fourth terminal 68B having a fixed contact 90*j* electrically connected to an external part.

Figure 2:
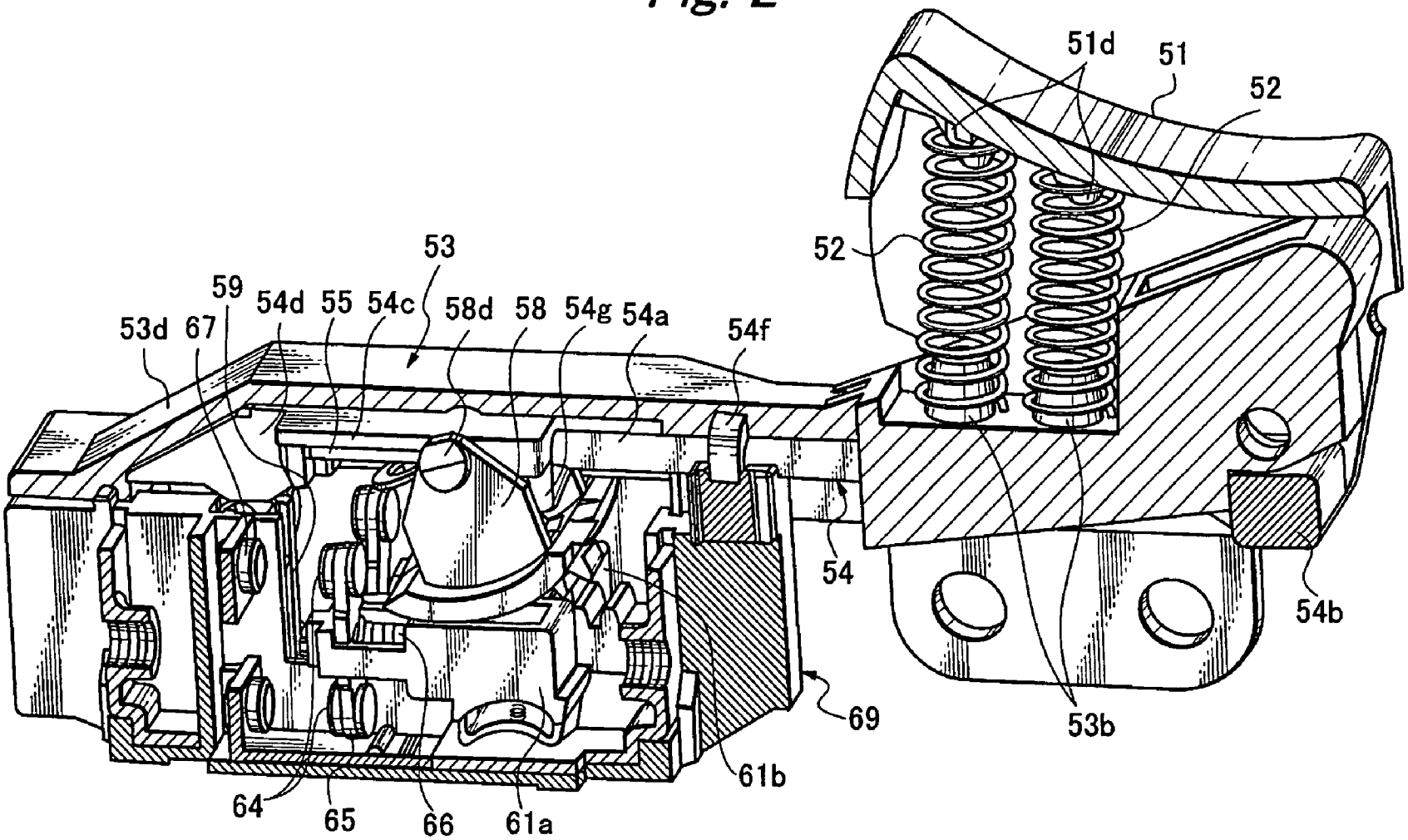
FIG. 2 is a vertically sectional side view of the trigger switch, showing the inside thereof.
Figure 3:
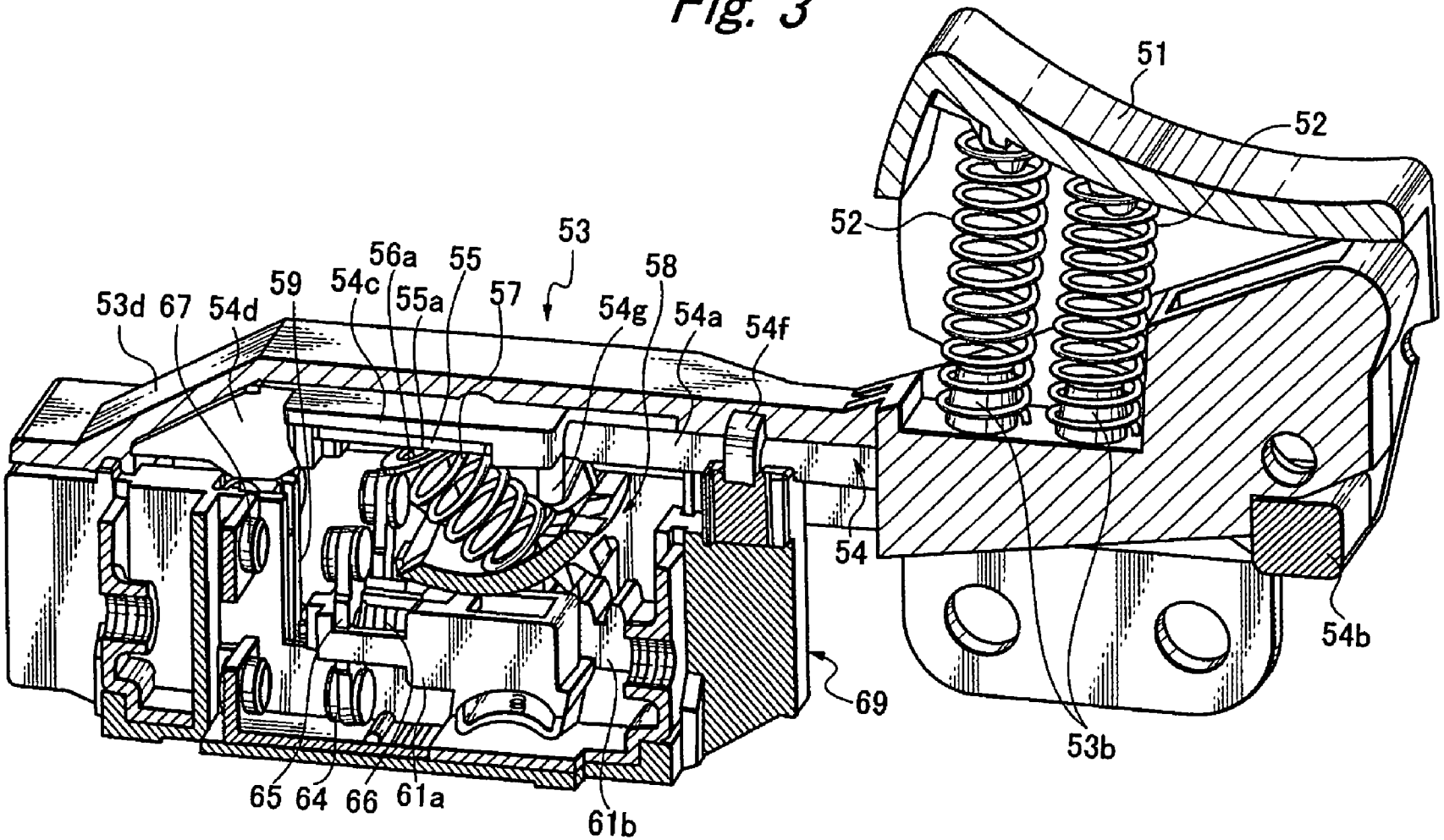
FIG. 3 is a vertically sectional side view of the trigger switch, showing the inside thereof.

FIGS. 2 and 3 are vertically sectional side views of the trigger switch 50. The operation part 51 is a part operated by a hand of a user of the trigger switch 50. Pressing the operation part 51 causes the trigger switch 50 to be turned on while releasing the operation part 51 causes the trigger switch 50 to be turned off. The operation part 51 is formed from a top surface curved so as to suit to the shape of a hand, right and left side surfaces and a front surface, which are formed into one body with the top surface, and open rear and lower surfaces. The operation part 51 is formed into the shape of a hollow case as a whole. The right and left side surfaces of the operation part 51 are provided on their rear parts with two holes 51*a*. The holes 51*a* are engaged with protrusions 53*a* provided in the most rear parts of the both side surfaces of the cover 53 to connect the operation part 51 and the cover 53 (see FIG. 1).

Two bearing holes 51*b* are provided on the right and left side surfaces of the operation part 51. A later-mentioned rotation shaft 54*e* of the plunger 54 is rotatably fitted into the bearing holes 51*b*. Further, through holes 51*c*, which are in the shape of a gourd for the sake of convenience in use, are provided in the both side surfaces of the operation part 51 (see FIG. 1). Moreover, the operation part 51 is provided inside the top plate thereof with two protrusions 51*d* (see FIG. 2) for holding upper ends of the return springs 52.

The two coiled return springs 52 are constantly urged in a direction of extension. The upper ends of the return springs 52 are fixed by means of the protrusions 51*d* (see FIG. 2) of the operation part 51. Lower ends of the return springs 52 are fixed by means of later-mentioned two protrusions 53*b* (see FIG. 2) provided on a bottom surface of the cover 53.

The cover 53 has functions different between a front half part and a rear half part, as shown in FIGS. 1 to 3. The rear half part has functions of holding the lower ends of the return springs 52 by means of the protrusions 53*b* and connecting to the rear end part of the operation part 51, as shown in FIGS. 2 and 3. The front half part of the cover 53 has a function as a lid of the case 69 to cover the plunger 54. An inclining part 53*d* provided at a most front part of the cover 53 forms a space inside which a pointed part 54*d* of the plunger 54 moves back and forth.

Right and left side plates of the cover 53 externally cover right and left side plates of the case 69, as shown in FIG. 1. Two claws 69*a* of the case 69 are arranged to be fitted in two through holes 53*e* to connect the cover 53 and the case 69.

The plunger 54 is comprised of, as shown in FIGS. 1 to 3, a rod part 54*a*, a rear block 54*b* fixed to a rear end of the rod part 54*a*, a rectangular stand-shaped member 54*c* fixed at a front end of the rod part 54*a*, the substantially triangular top end part 54*d*, which is formed at a front part of and into one body with the stand-shaped member 54*c* and which has a pointed top end, a first protrusion part 54*g* projecting downward at the rear part of the stand-shaped member 54*c*, a protrusion 55*a* (see FIG. 3) projecting downward from the center of a metal guide plate 55 mounted to a lower surface of the stand-shaped member 54*c* and a packing 54*f*.

On right and left side surfaces of the rear block 54*b*, formed is the rotation shaft 54*e* (see FIG. 1). The rotation shaft 54*e* is fitted in the bearing holes 51*b* of the operation part 51. Rotation movement of the operation part 51 is transmitted to the rear block 54*b* through the bearing holes 51*b*. The rod part 54*a* transmits a movement of the rear block 54*b* in the back-and-forth direction to the stand-shaped member 54*c*.

The top end part 54*d* is in the shape of a plate projecting from a center member in the right-and-left direction of the stand-shaped member 54*c*, the plate having the side surfaces in a substantially acute-angled triangle-shape. An outline of a top surface of the top end part 54*d* in a side view is arranged to accord with an inner surface of the inclining part 53*d* of the cover 53. A lower surface of the top end part 54*d* includes two horizontal surfaces having a difference in level and an inclining surface connecting the two horizontal surfaces. That is to say, the top end part 54*d* is formed from a first horizontal surface extending from the top end to a center part, a first straight inclining surface extending downward from an end of the first horizontal surface, a second horizontal surface connected from an end of the first inclining surface and a second inclining surface getting narrow upward from an end of the second horizontal surface to the stand-shaped member 54*c*.

The lower surface of the top end part 54*d*, which is in the above shape, is constantly in contact with a top end (an inclining surface 59*b*) of a later-mentioned stopper member 59. This allows a function of controlling vertical movement of the stopper member 59 to be achieved simultaneously with achievement of a close relation with timing of turning on/off a contact.

The protrusion 55*a* engaged with the guide plate 55 is engaged with the plate 56*a* to be connected with an upper end of the reverse spring 57. The packing 54*f* has a center hole for the rod part 54*a* passing therethrough and is fitted into a connection surface between the cover 53 and the case 69 to prevent dust caused by the plunger 54 moving in the back-and-forth direction from entering the inside of the switch.

The guide plate 55 is a rectangular plate to be fitted between teeth in a lower surface of the stand-shaped member 54*c* of the plunger 54. A top end of the protrusion 55*a* (see FIG. 3) provided at the center of the guide plate 55 is engaged with the plate 56*a*. The upper plate 56*a* of the two disc-shaped plates 56*a* and 56*b* has a concave having a diameter larger a little than that of the protrusion 55*a* (see FIG. 3) at its center. The plate 56*a* is arranged to be capable of inclining freely like a spinning top when the top end of the protrusion 55*a* is in contact with the concave. Movement of the plunger 54 in the back-and-forth direction is transmitted from the protrusion 55*a* to the upper end of the reverse spring 57 through the plate 56*a*.

The lower plate 56*b* of the two disc-shaped plates 56*a* and 56*b* has a concave at its center, the concave having a diameter larger a little than that of a protrusion provided in the reverse member 58. The plate 56*b* is arranged to be capable of inclining freely like a spinning top when a circular top end of the protrusion of the reverse member 58 is in contact with the concave.

The coiled reverse spring 57 is held between the two plates 56*a* and 56*b* with predetermined pressure. The reverse spring 57 is bent in the back-and-forth direction to accumulate spring force when the plate 56*a* is moved by means of the plunger 54. A state that the spring force is most accumulated is called a reverse point.

The reverse member 58 is comprised of a curved plate 58*a* formed from a rectangular plate shorter in length than the inner width of the cover 53 in the left-and-right direction, the rectangular plate being curved in the longitudinal and right-angled direction into the shape of an arc, two right and left partition plates 58*b* erected on an inner surface of the curved plate 58*a* with a space larger a little than the diameter of the plate 56*b*, a long and narrow pinion 58*c* provided along a lower surface of the curved plate 58*a* at its center part and protrusions 58*d* provided at respective upper end parts of the two partition plate 58*b*.

The two partition plates 58*b* are for containing the reverse spring 57. The pinion 58*c* is engaged with the rack part 61*c* of the actuator 61, which will be mentioned later. This allows a function of converting rotation of the reverse member 58 into straight movement of the actuator 61 in the back-and-forth direction to be achieved. The protrusions 58*d* are engaged with two holes provided inside the upper surface of the cover 53, and thereby, form a rotation center of the reverse member 58.

The reverse member 58 constantly receives pressure by means of the reverse spring 57. The pressure is the largest at the reverse point of the reverse spring 57.

The stopper member 59 is formed into the shape of L as a whole. A vertical part of the stopper member 59 is fitted into a vertical groove provided at the center in the right-and-left direction of the case 69 in the most front part so as to be freely slidable. The inclining surface 59*b* extending downward to the rear side is formed in an upper end surface of the vertical part. The upper end surface is in contact with the lower surface of the top end part 54*d* of the plunger 54.

A horizontal part of the stopper member 59 projects rearward in parallel to the bottom surface of the case 69. In a top surface of a top end part of the horizontal part, formed into one body is a claw part 59*a* having an inclination extending downward from the front side to the rear side. The claw part 59*a* is to be engaged with a lock part 85 (see FIGS. 5 and 14) of the actuator 61.

The stopper spring 60 is housed in a hole provided in a lower part of the vertical part of the stopper member 59 and has a function to constantly urge the stopper member 59 upward. Accordingly, the stopper member 59 performs vertical movement in accordance with the shape of the lower surface of the top end part 54*d* when plunger 54 moves back and forth.

That is to say, the stopper member 59 is pressed down against the stopper spring 60 when the upper end of the vertical part of the stopper member 59 is in contact with the second horizontal surface, which is the lower surface, of the top end part 54*d* of the plunger 54, as shown in FIG. 2, for example. In accordance with movement of the top end part 54*d* rearward, however, extension force of the stopper spring 60 makes the top end of the vertical part rise along the first inclining surface. The stopper member 59 is kept at an upper part while the top end of the vertical part is in contact with the first horizontal surface of the top end part 54*d*.

Each length of the horizontal surface and the inclining surface of the lower surface of the top end part 54*d* is designed, taking account of time of engagement between the claws part 59*a* of the stopper member 59 and the lock part 85 of the actuator 61, namely, timing of separation of the contacts in turning off the switch.

Figure 4:
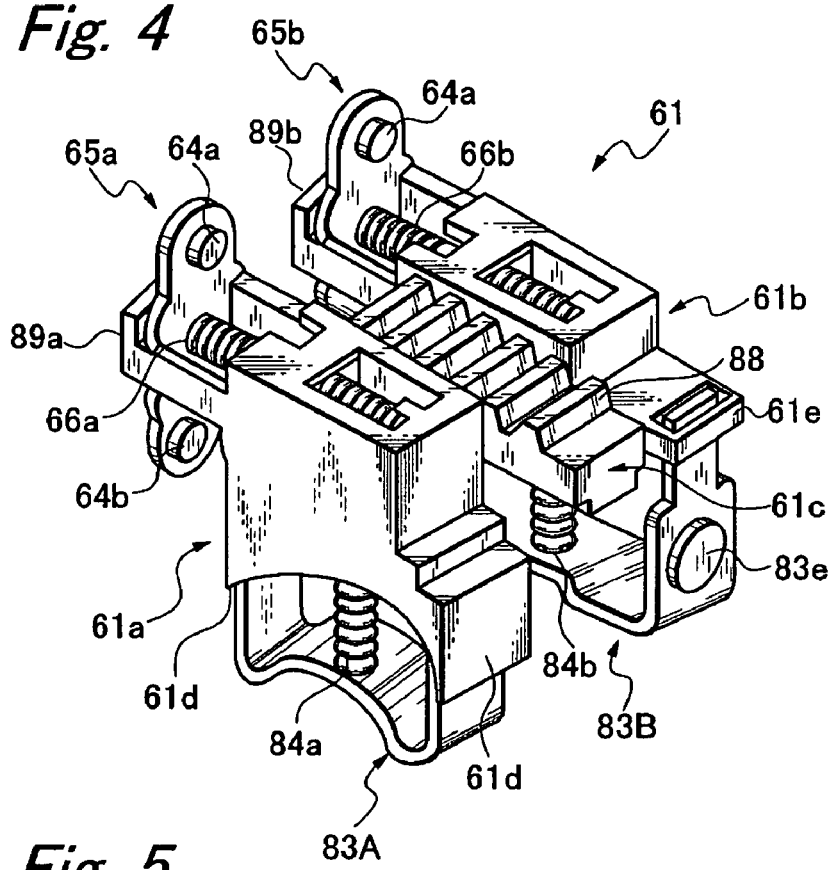
FIG. 4 is a perspective view of an actuator of the trigger switch.
Figure 5:
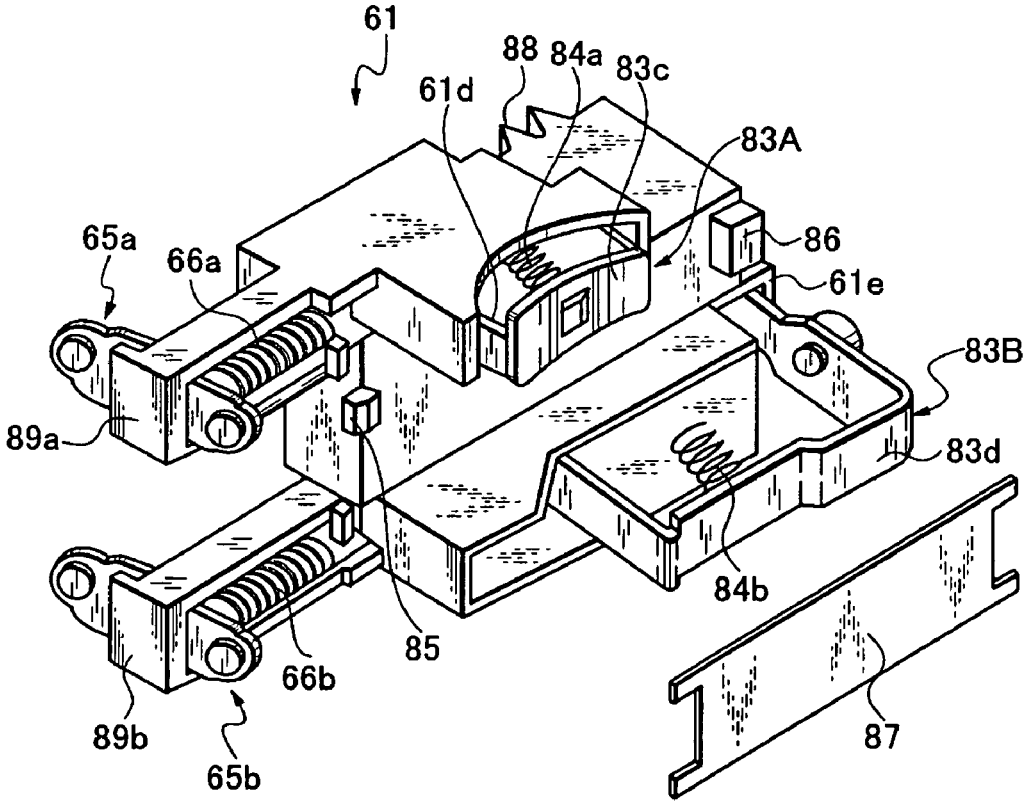
FIG. 5 is a perspective view of the actuator, looking from another angle.

The actuator 61 is comprised of, as shown in FIGS. 1, 4 and 5, the rack part 61*c* formed from a rack 88 arranged in the horizontal direction so as to engage with the pinion 58*c* of the reverse member 58, the two box-shaped guide parts 61*a* and 61*b* formed into one body on the right and left sides of the rack part 61*c*, the movable contact pieces 65*a* and 65*b* mounted to respective front ends of the two guide parts 61*a* and 61*b*, the movable contacts 64*a* and 64*b*, which are mounted to upper and lower parts of front surfaces of the movable contact pieces 65*a* and 65*b* and which are two each for right and left sides, namely, four in number in total, the pressure springs 66*a* and 66*b* contained in the box-shaped guide parts 61*a* and 61*b* for pressuring the movable contact pieces 65*a* and 65*b* from the rear side, and the auxiliary contact engaging parts 61*d* and 61*e* for engaged with the first and second auxiliary contacts 83A and 83B, which are formed into one body in a lower surface at a position of a lower part of the guide parts 61*a* and 61*b*, with the first and second auxiliary contacts 83A and 83B being urged by spring pressure of the auxiliary springs 84*a* and 84*b*.

Top end engaging parts 89*a* and 89*b* are top end parts constantly urged with urging force of the pressure springs 66*a* and 66*b* and hold the movable contact pieces 65*a* and 65*b* of the guide parts 61*a* and 61*b*. The top end engaging parts 89*a* and 89*b* have a function as a stopper when the movable contacts 64*a* and 64*b* of the movable contact pieces 65*a* and 65*b* come into contact with the fixed contacts 63A, (63B) and 67A (and 67B) (see FIG. 16) and are further pushed to strengthen the urging force of the pressure springs 66*a* and 66*b*.

On a bottom surface of the rack part 61*c*, provided is the lock part 85 (see FIG. 5), which is to lock in the claw part 59*a* of the stopper member 59 and which is formed from a convex part having an inclining part on one side. An engaging convex part 86 is provided at an end opposite to the lock part 85 on the same bottom surface. A slider 87, which is formed from another member, is arranged to be mounted to the bottom surface between the lock part 85 and the engaging convex part 86.

The first auxiliary contact 83A is formed from a conductive member into the shape of substantial C. An outer surface at a center position of the C-shaped part functions as a contact piece 83*c*. One end of the C-shaped part is engaged with the auxiliary contact engaging part 61*d* to be locked. The auxiliary spring 84*a* is engaged with an inner surface of the locked first auxiliary contact 83A. The first auxiliary contact 83A is thus arranged to be one-sidedly engaged with the auxiliary contact engaging part 61*d*.

The second auxiliary contact 83B is formed from a conductive member one size larger than the first auxiliary contact 83A into the shape of substantial C. An outer surface at a center position of the C-shaped part functions as a contact piece 83*d*. One end of the C-shaped part is engaged with the auxiliary contact engaging part 61*e* to be locked.

The auxiliary spring 84*b* is engaged with an inner surface of the locked second auxiliary contact 83B. The second auxiliary contact 83B is thus arranged to be one-sidedly engaged with the auxiliary contact engaging part 61*e*. A side surface on a free end side in the one-sided state is provided with a movable contact 83*e*. The movable contact 83*e* functions as a so-called brake contact. It is arranged that the movable contact 83*e* comes into contact with the fixed contact 90*j* of the fourth terminal 68B to short-circuit a motor not shown so as to put on a brake when the movable contact 83*e* is not drawn by the operation part. This will be described later.

The actuator 61 having the above structure is driven by the reverse member 58 on the actuator guide laid in the case 69 in the back-and-forth direction to horizontally move in the back-and-forth direction with the movable contacts 64*a* and 64*b*. This gives the actuator 61 a contact switching function, which is an original function of a switch. That is to say, the movable contacts 64*a* and 64*b* come into contact with the later-mentioned fixed contacts 63A and 67A (63B and 67B) when the actuator 61 moves forward while the movable contacts 64*a* and 64*b* go away from the fixed contacts 63A and 67A (63B and 67A) when the actuator 61 moves rearward. A slide of the first and second auxiliary contacts 83A and 83B, which form an auxiliary contact mechanism, in accordance with movement of the contacts allows auxiliary contact slide plate parts 81A and 82A, and 81B and 82B to be electrically connected. This will be also described later.

Figure 6:
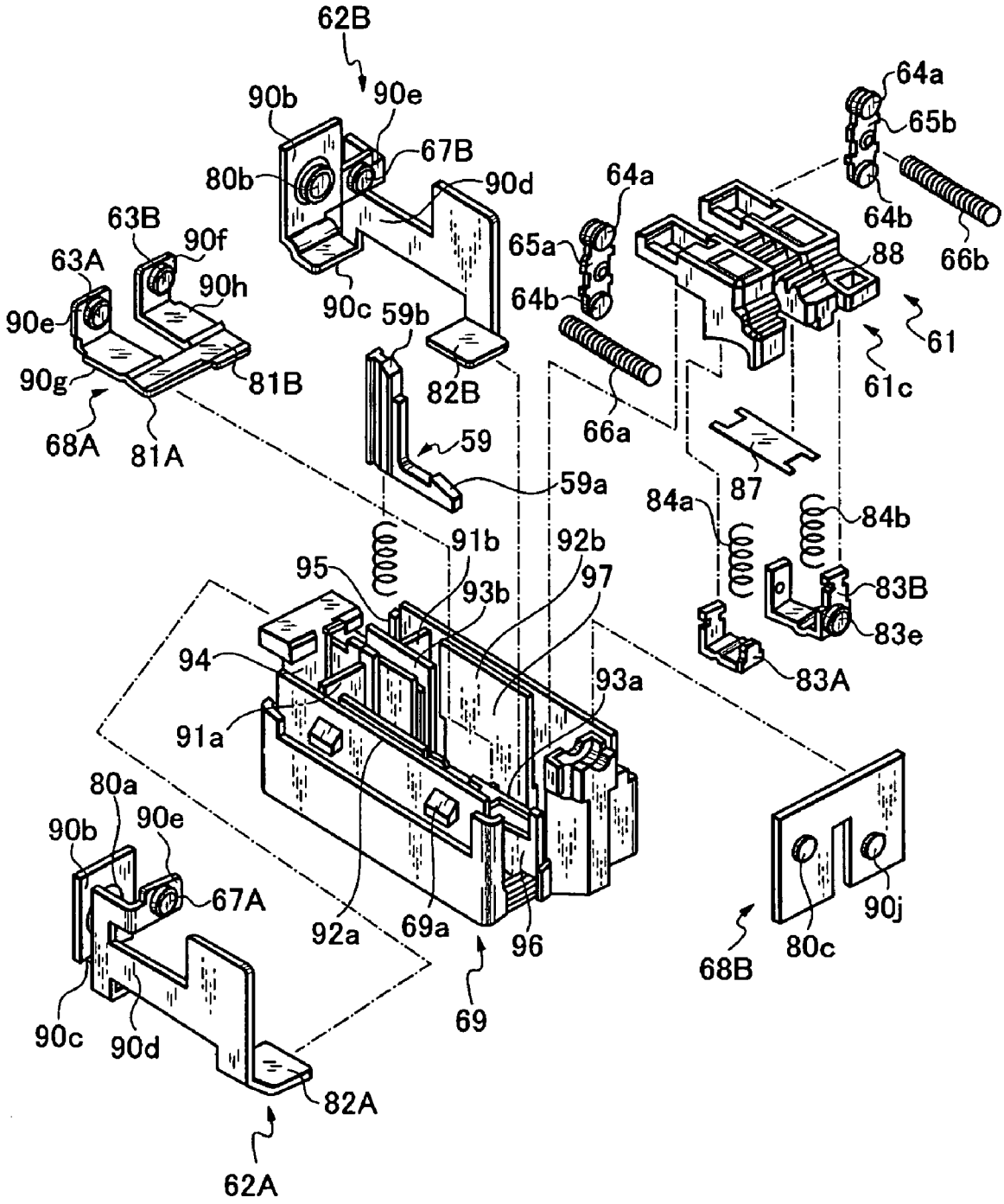
FIG. 6 is an exploded perspective view of a case of the trigger switch and contents thereof.

The first terminal 62A is comprised of an external connection terminal part 90*b* having a screw hole 80*a* at a center part of a flat plate formed from a conductive plate member, one end side of the conductive plate member being erected, as shown in FIG. 6. The external connection terminal part 90*b* is bent at right angles to form a base part 90*c*. A left end part of the base part 90*c* is further bent at right angles to form an engaging plate part 90*d*. A surface connected from the engaging plate part 90*d* is bent at right angles to form a contact part 90*e* having the fixed contact 67A. An end side connected from the engaging plate part 90*d* is bent at right angles in a direction same as that of the base part 90*c* to form the auxiliary contact slide plate part 82A.

The second terminal 62B is in the shape symmetrical to that of the first terminal 62A. The second terminal 62B is comprised of an external connection terminal part 90*b* having a screw hole 80*b* at a center part of a flat plate formed from a conductive plate member, one end side of the conductive plate member being erected. The external connection terminal part 90*b* is bent at right angles to form a base part 90*c*. A right end part of the base part 90*c* is further bent at right angles to form an engaging plate part 90*d*. A surface connected from the engaging plate part 90*d* is bent at right angles to form a contact part 90*e* having the fixed contact 67B. An end side connected from the engaging plate part 90*d* is bent at right angles in a direction same as that of the base part 90*c* to form the auxiliary contact slide plate part 82B.

The third terminal 68A is formed from a conductive plate member into the shape of a fork. A top end side of one flat plate part 90*g* of the fork is bent at right angles to form a contact part 90*e* having the fixed contact 63A. A top end side of the other flat plate part 90*h* is bent at right angles to form a contact part 90*f* having the fixed contact 63B. The auxiliary contact slide plate part 81A is provided on a base part side connected from the flat plate part 90*g*. The auxiliary contact slide plate part 81B formed wider than the auxiliary contact slide plate part 81A is provided connectedly from the flat plate part 90*h* and the auxiliary contact slide plate part 81A. Free end parts of the auxiliary contact slide plate parts 81A and 81B are beveled and worked so that the auxiliary contacts would be smoothly slidable.

The fourth terminal 68B is formed from a conductive plate member into a substantially quadrilateral shape. A notch is formed at the center of a bottom part of the quadrilateral. It is arranged in the drawing with the notch that the fixed contact 90*j* be provided on a right side of the flat plate while the screw hole 80*c* be provided on a left side of the flat plate.

In the case 69, arranged and fixed are the first to fourth terminals 62A, 62B, 68A and 68B including the above-mentioned fixed contacts 63A, 63B, 67A and 67B, as shown in FIG. 6. The case 69 further contains the actuator 61 including the movable contacts 64*a* and 64*b* to move the actuator 61 straight. The case 69 is formed from insulating resin into the shape of a box having an opening at an upper part thereof. Inside the case 69, formed are four compartments capable of containing the first to four terminals 62A, 62B, 68A and 68B. The case 69 is comprised of a support wall 91*a* for externally providing the external connection terminal part 90*b* of the first terminal 62A. A first compartment 94 is formed in a space held among a longitudinal inner wall 92*a*, the support wall 91*a*, a stopper guide 93*b* for engaging with the stopper member 59 formed projectingly from the center to the inner side, and an actuator guide 93*a* forming a linear convex part provided at the center in a position extended from the stopper guide 93*b*. At a position adjacent to the first compartment 94 over the actuator guide 93*a*, a second compartment 95 is formed in a space held among the similarly longitudinal inner wall 92*b*, a support wall 91*b* and the actuator guide 93*a*.

A third compartment 96 is formed in a space held between the actuator guide 93*a* and the inner wall 92*a* at a position faced to the first compartment 94 with the external connection terminal part 90*b* of the first terminal 62A being faced to the outside. Further, a fourth compartment 97 is formed in a space held between the actuator guide 93*a* and the inner wall 92*b* at a position faced to the second compartment 95 with the external connection terminal part 90*b* of the second terminal 62B being face to the outside.

Figure 7:
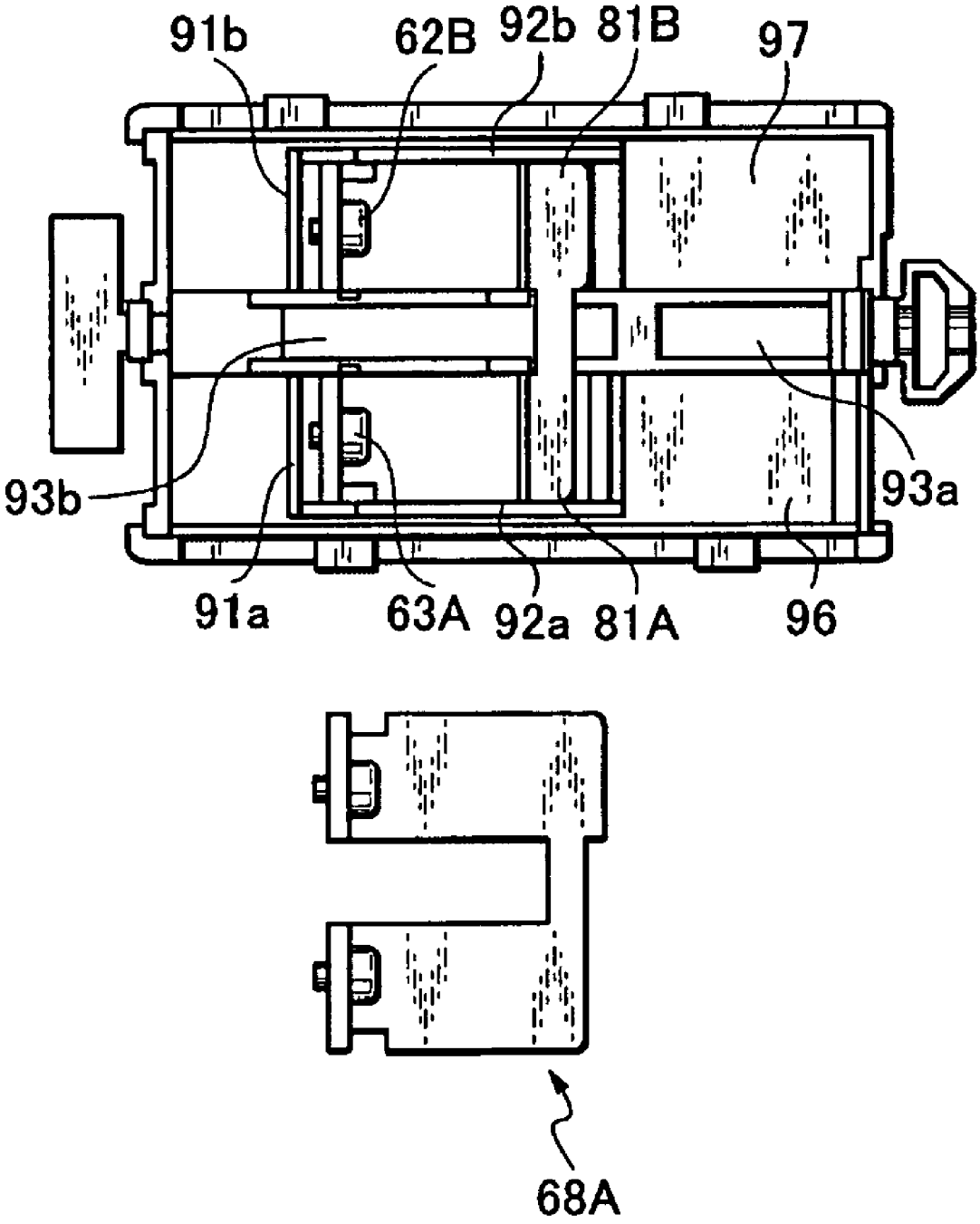
FIG. 7 is a plan view showing a state that a third terminal is housed in the case.

The third terminal 68A is first contained in the third and fourth compartments 96 and 97 as shown in FIG. 7 in order to engage and fix the first to fourth terminals 62A, 62B, 68A and 68B with and to the case 69 having such a structure. That is to say, the stopper guide 93*b* is put in a notched groove of the third terminal 68A to be pushed to the bottom so that the fixed contacts 63A and 63B would be arranged horizontally to the compartments and the auxiliary contact slide plate parts 81A and 81B would be arranged vertically to the compartments.

Figure 8:
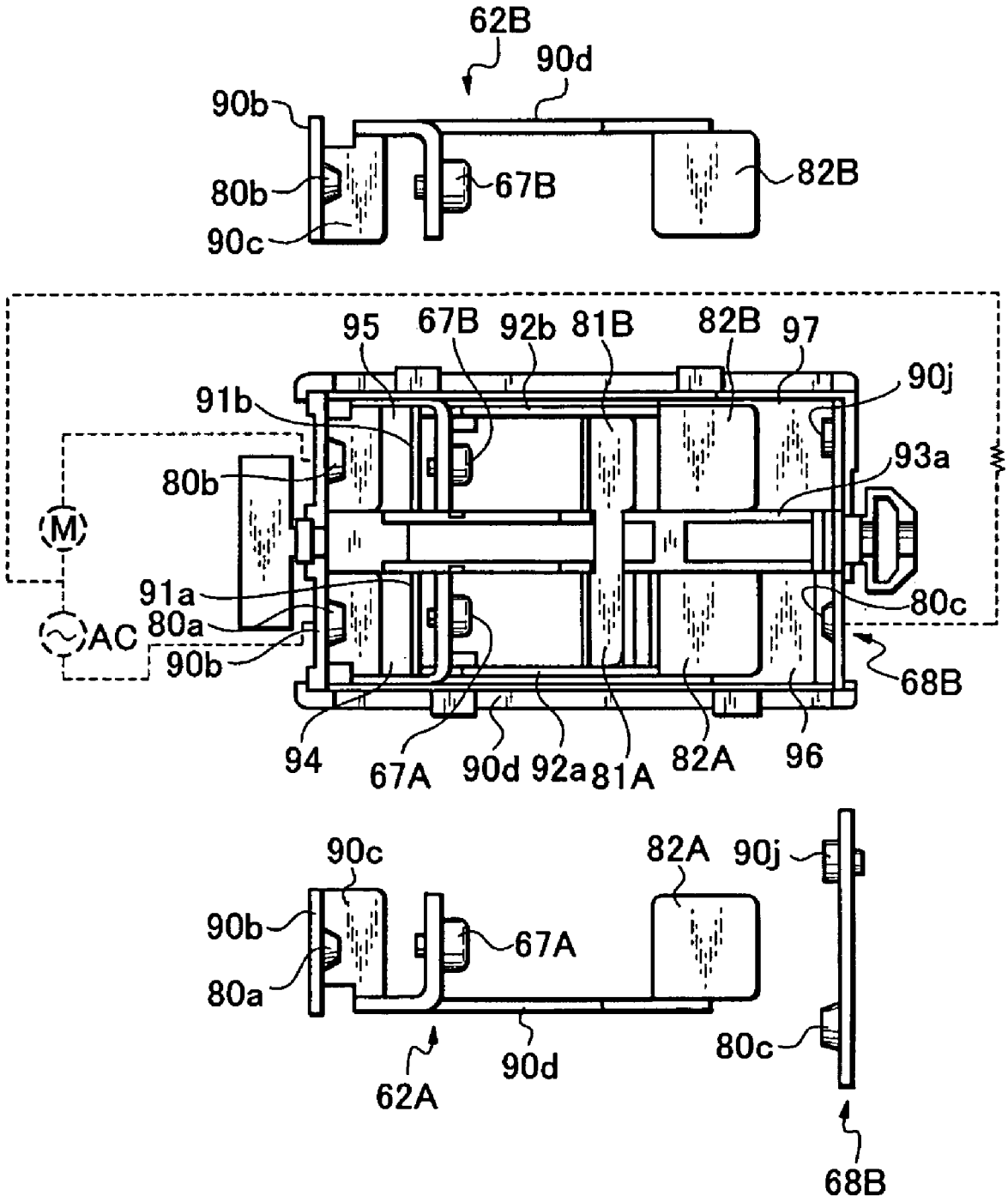
FIG. 8 is a plan view showing a state that first, second and fourth terminals are housed in the case.

The first terminal 62A is then contained in the first and third compartments 94 and 96 as shown in FIG. 8. That is to say, the external connection terminal part 90*b* of the first terminal 62A is engaged with a slit of the support wall 91*a* and the engaging plate part 90*d* is engaged with a slit of the inner wall 92*a* to be pushed. This allows the first terminal 62A to be arranged so that the fixed contact 67A would be faced inward horizontally to the compartments. The auxiliary contact slide plate part 82A is arranged in the bottom part of the third compartment 96 so as to be vertical to the compartment.

Moreover, the second terminal 62B is contained in the second and fourth compartments 95 and 97. That is to say, the external connection terminal part 90*b* of the second terminal 62B is engaged with a slit of the support wall 91*b* and the engaging plate part 90*d* is engaged with a slit of the inner wall 92*b* to be pushed. This allows the second terminal 62B to be arranged so that the fixed contact 67B would be faced inward horizontally to the compartments. The auxiliary contact slide plate part 82B is arranged in the bottom part of the fourth compartment 97 so as to be vertical to the compartment.

Following to the above, the fourth terminal 68B is contained in the third and fourth compartments 96 and 97, as shown in FIG. 8. That is to say, the plate-shaped fourth terminal 68B is engaged with a slit provided in a sidewall surface of the case to be pushed. This allows the fourth terminal 68B to be arranged and fixed so that the fixed contact 90*j* would be faced inward.

Containing and fixing the four first to fourth terminals 62A, 62B, 68A and 68B in and to the case 69 as described above allows the fixed contacts 63A, 63B, 67A and 67B to be faced in the same direction and the auxiliary contact slide plate parts 81A, 81B, 82A and 82B in which the auxiliary contacts slide to be arranged in a bottom surface of the case 69, so that the fixed contact 90*j* is arranged so as to be faced to the fixed contact 63B.

Putting the actuator through the opening of the case 69 under such a condition allows the movable contacts to be arranged to face to the fixed contacts and the auxiliary contacts to be arranged to be in contact with upper parts of the auxiliary contact slide plate parts. Accordingly, the movable contacts of the actuator are arranged to be in contact with the fixed contact 90*j* of the fourth terminal 68B.

Each of the screw hole 80*a* of the first terminal 62A, the screw hole 80*b* of the second terminal 62B and the screw hole 80*c* of the fourth terminal 68B is connected to the motor M and a power source AC via an electric wire as shown by a dotted line in FIG. 8.

The movable contacts 64*a* and 64*b* come into contact with the fixed contacts 63A and 67A, and 63B and 67B by means of a contact mechanism of a switch, which is achieved by coordinated movements of the plunger 54, the reverse member 58, the actuator 61 and such, so as to be slowly turned on and fast turned off. The auxiliary movable contact comes into contact with the auxiliary fixed contact only when the movable contact is in contact with the fixed contact. The auxiliary movable contact does not come into contact with the auxiliary fixed contact in the case that the movable contact is not in contact with the fixed contact.

Now, described will be an operation of the contact mechanism of a switch in accordance with the invention, made reference to FIGS. 9 to 11 and 12 to 16.

Figure 9:
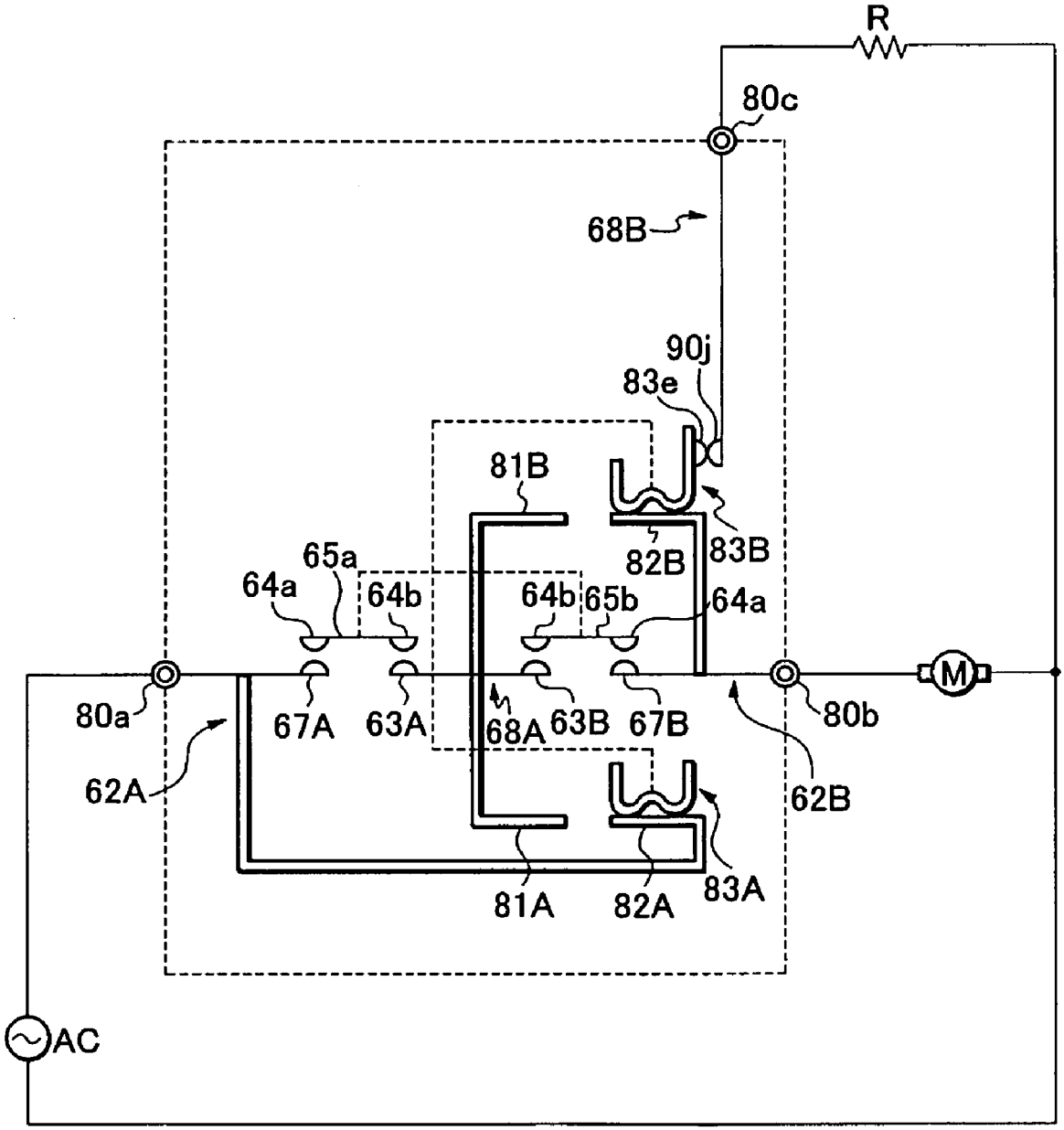
FIG. 9 is a circuit diagram schematically showing a state of contact of a fixed contact, a movable contact and an auxiliary contact, which form the trigger switch, in the case that an operation part is not drawn.

In a circuit diagram shown in FIG. 9, shown as a circuit diagram is a contact state of the auxiliary contact in addition to contact states of the fixed contacts and the movable contacts. The circuit diagram is characterized by providing main contacts connected double in series and a brake contact for the auxiliary contact. That is to say, the main contacts double in series correspond to the fixed contact 67A of the first terminal 62A and the fixed contact 63A of the third terminal 68A for the movable contacts 64*a* and 64*b* of the movable contact piece 65*a* of the actuator 61 and the fixed contact 67B of the second terminal 68A and the fixed contact 63B of the third terminal 68A for the movable contacts 64*a* and 64*b* of the movable contact piece 65*b* of the actuator 61 while the single brake contact corresponds to the movable contact 83*e* of the second auxiliary contact 83B sliding on the second terminal 62B for the fixed contact 90*j* of the fourth terminal 68B.

In the circuit diagram having such a structure, the movable contact 83*e* of the second auxiliary contact 83B comes into contact with the fixed contact 90*j* of the fourth terminal 68B to short-circuit the motor M, and thereby, to keep a brake being put on when the operation part is not operated. Drawing the operation part causes the actuator to move and the first auxiliary contact 83A and the second auxiliary contact 83B to slide. Especially a slide of the second auxiliary contact 83B causes the movable contact 83*e* to separate from the fixed contact 90*j*, which is in contact with the movable contact 83*e*, so that a short circuit of the motor M is released.

Figure 10:
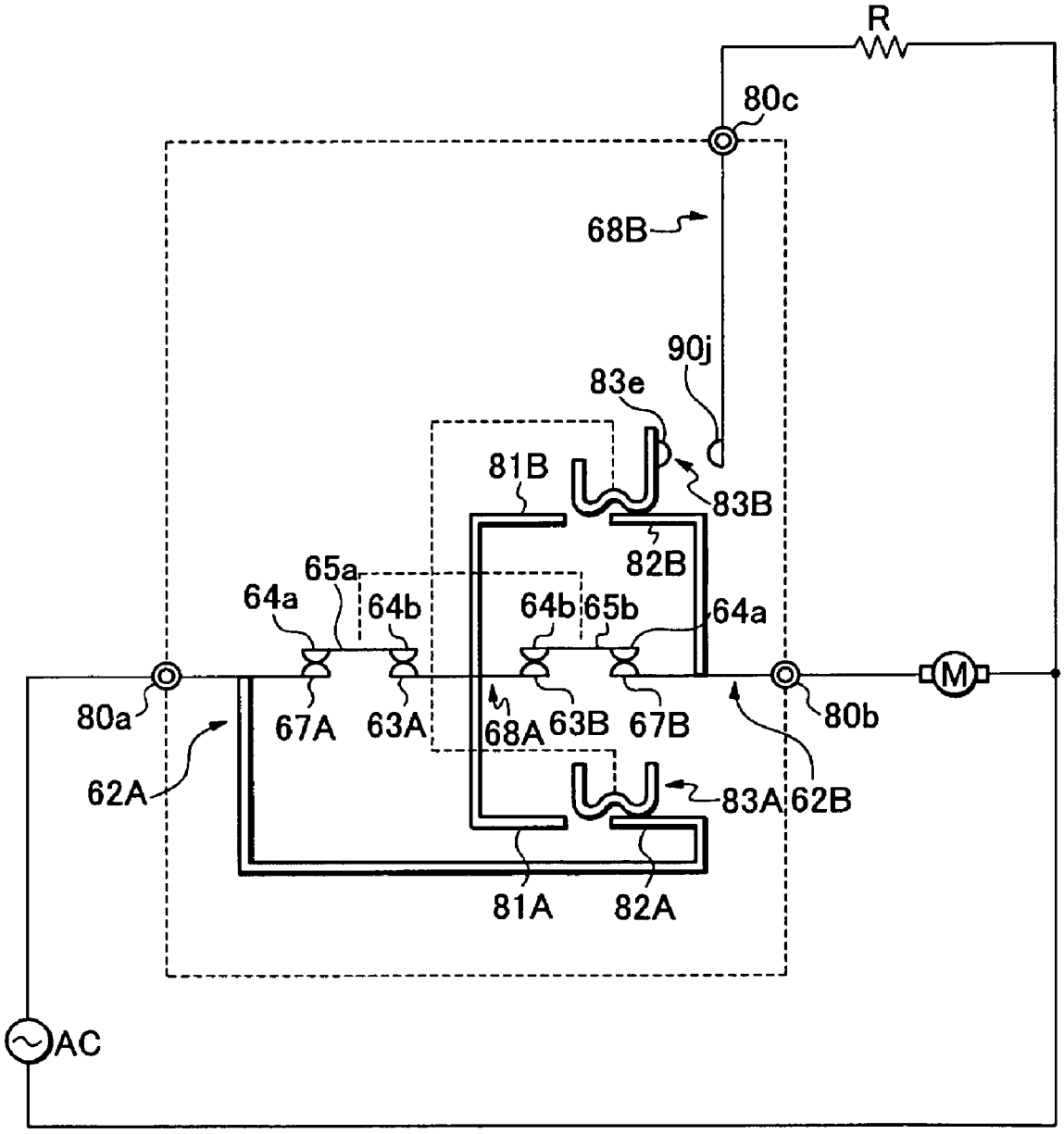
FIG. 10 is a circuit diagram schematically showing a state of contact of the fixed contact, the movable contact and the auxiliary contact in the case that an operation part is drawn to bring the fixed contact into contact with the movable contact.

Further drawing the operation part after the above causes the movable contacts 64*a* and 64*b* of the movable contact piece 65*a* to come into contact with the fixed contact 67A of the first terminal 62A and the fixed contact 63A of the third terminal 68A and causes the movable contacts 64*a* and 64*b* of the movable contact piece 65*b* to come into contact with the fixed contact 63B of the third terminal 68A and the fixed contact 67B of the second terminal 62B, as shown in FIG. 10. At that time, the first auxiliary contact 83A and the second auxiliary contact 83B, which are the auxiliary contacts, slide to middle parts of the auxiliary contact slide plate parts 82A and 82B and do not reach the auxiliary contact slide plate parts 81A and 81B. That is to say, at that time, contact of the contacts causes the main contacts double in series to turn on to supply the motor M with power, and thereby, the motor M is made rotatable.

Figure 11:
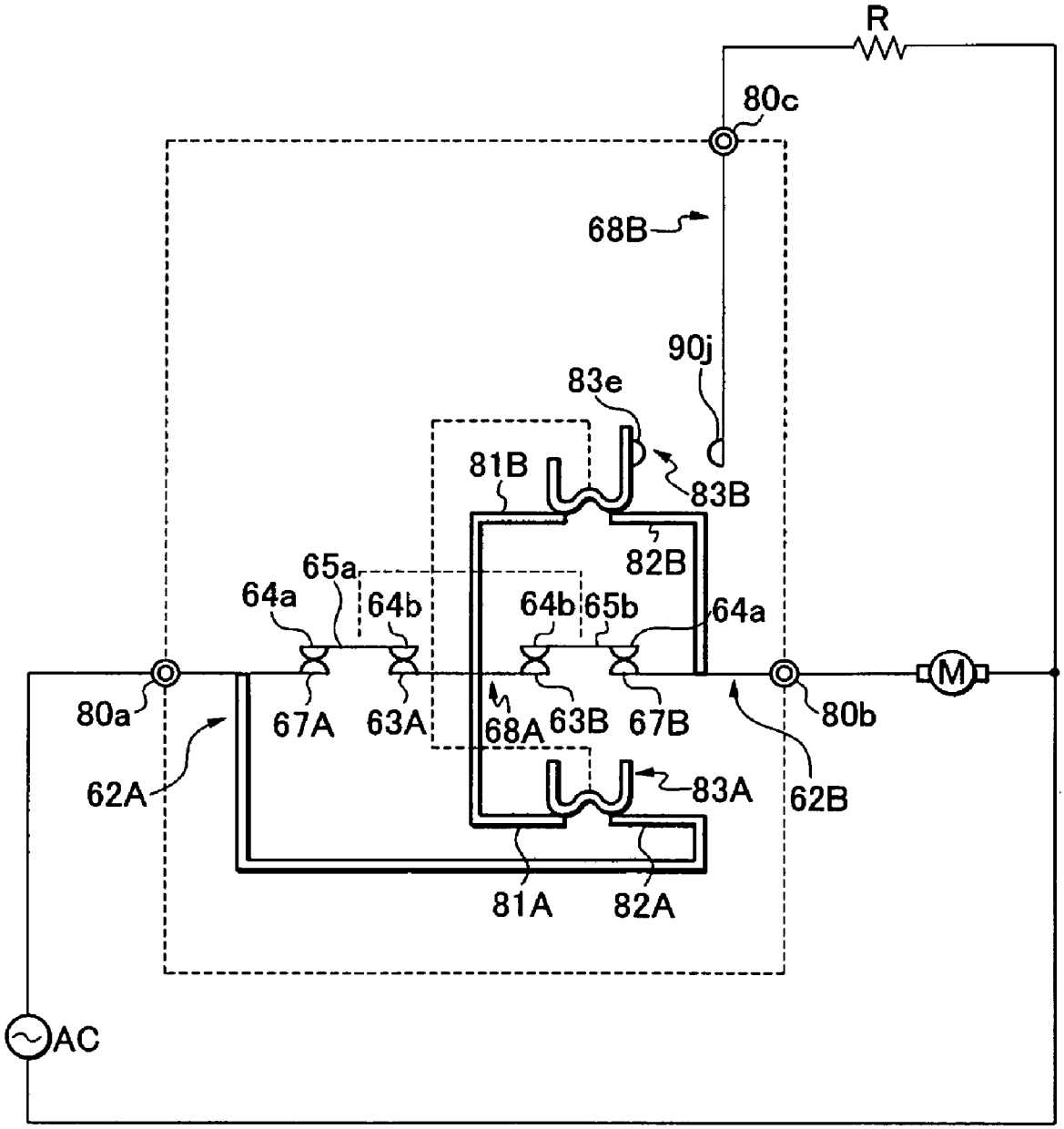
FIG. 11 is a circuit diagram schematically showing a state of contact of the fixed contact, the movable contact and the auxiliary contact in the case that an operation part is further drawn to make the auxiliary contact into contact under a condition that the fixed contact is in contact with the movable contact.

Further drawing the operation part following to the above causes the main contacts double in series to be in contact under the increased urging force of the spring, as shown in FIG. 11, and then, the state is locked although this is not shown. The first and second auxiliary contacts 83A and 83B bridge over the auxiliary contact slide plate parts (81A and 82A, and 81B and 82B), so that conduction is achieved. The opening of a path for supplying the motor with power from the auxiliary sides allows the unstable contact between the fixed contacts and the movable contacts to be compensated on the auxiliary contact sides, so that stable conduction can be achieved as a whole.

Moreover, stopping drawing of the operation part under the above condition causes the fixed contacts and the movable contacts to be changed in state from on to off and the conduction at the auxiliary contact not to be achieved. The movable contact 83*e* of the second auxiliary contact 83B finally comes into contact with the fixed contact 90*j* to short-circuit the motor M, and thereby, to put on a brake.

The contact operation between the main contacts and the brake contact is described above. Now, described will be an actual operation of the switch mechanism, made reference to FIGS. 12 to 16.

Figure 12:
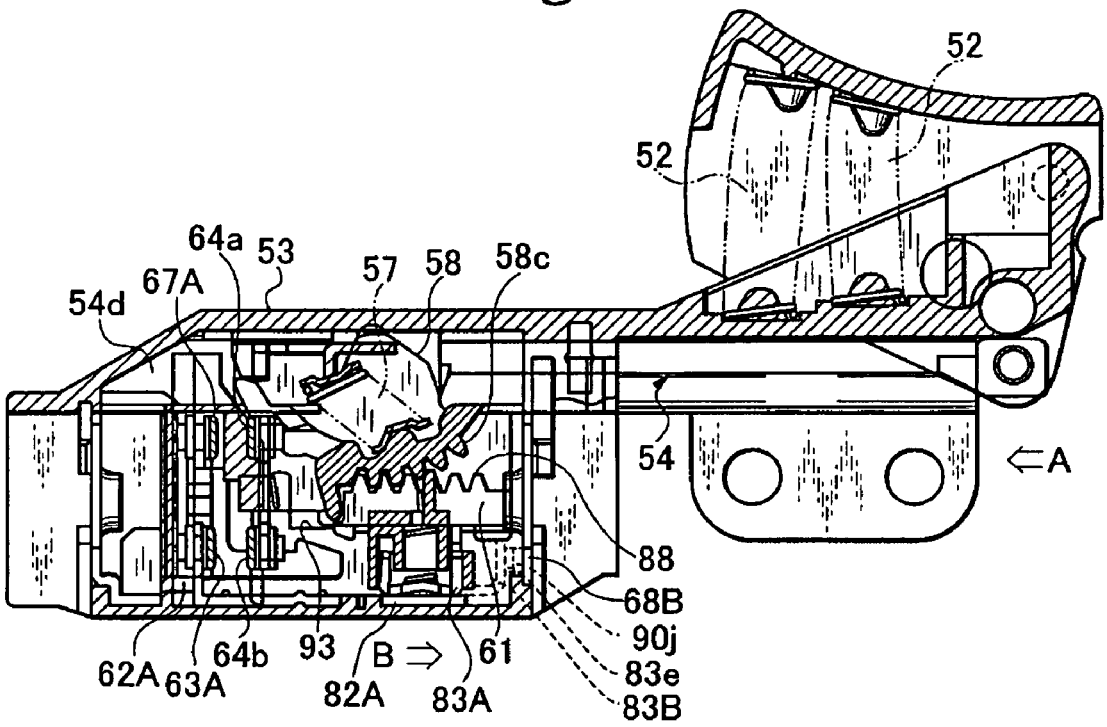
FIG. 12 is a vertically sectional side view of a switch in the case that the operation part is off.

In FIG. 12, the plunger 54 is urged in a direction of an arrow A by means of spring force of the return spring 52 in the case of an off state under which the switch is not operated. The pointed part 54*d* of the plunger 54, however, is pressed against an inner wall of the cover 53, and therefore, not movable. The reverse member 58 is pressured by the reverse spring 57 to be urged counterclockwise under such a condition. Accordingly, the actuator 61 on the actuator guide 93 is urged to a direction B but cannot move. The first auxiliary contact 83A is stopped in contact with the auxiliary contact slide plate part 82A of the first terminal 62A at that time. The second auxiliary contact 83B is also stopped in contact with the auxiliary contact slide plate part 82B of the second terminal 62B, similarly, as a part of the above is shown in FIG. 12. The movable contact 83*e* provided in the second auxiliary contact 83B is simultaneously in contact with the fixed contact 90*j* provided in the fourth terminal 68B to achieve an electrically connected state.

Figure 13:
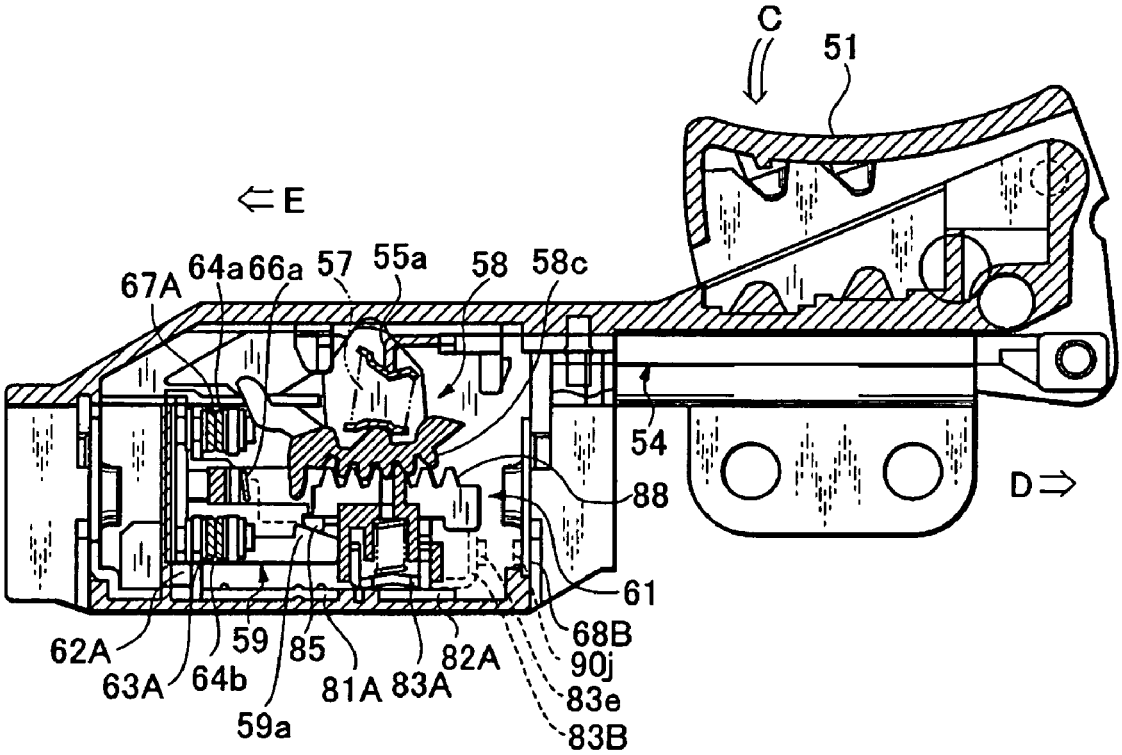
FIG. 13 is a vertically sectional side view of a switch in the case that the operation part is operated to bring a contact into contact.

Drawing the operation part 51 to move the same in a direction C under such a condition causes the plunger 54 to be drawn in a direction D, and thereby, the protrusion 55*a* located at an upper end of the reverse spring 57 of the reverse member 58 is drawn in the same direction D (the right direction in FIG. 13), as shown in FIG. 13. Accumulated energy of the reverse spring 57 then reaches the reverse point.

Extension force of the reverse spring 57 makes the reverse member 58 strongly rotate in a direction of an arrow E at the reverse point of the reverse spring 57. When the reverse member 58 rotates in the direction of the arrow E (the left direction in FIG. 13), the rack 88 of the rack part 61*c* engaged with the pinion 58*c* of the reverse member 58 moves horizontally in the direction of the arrow E. This results in contact between the movable contacts 64*a* and 64*b* and the fixed contacts 67A and 63A. The first auxiliary contact 83A is still in contact with the auxiliary contact slide plate part 82A of the first terminal 62A and a partition part of the case 69 at that time. The movable contact 83*e* provided in the second auxiliary contact 83B simultaneously separates from the fixed contact 90*j* provided in the fourth terminal 68B.

Furthermore, the lock part 85 of the actuator 61 is located on the claw part 59*a* of the stopper member 59. Accordingly, the contact state between the fixed contacts 67A and 63A and the movable contacts 64*a* and 64*b* is not locked since it is based on a condition of a pushing operation of the operation part 51. Moreover, the urging force of the pressure spring 66*a* for the movable contacts 64*a* and 64*b* is constant urging force.

Figure 14:
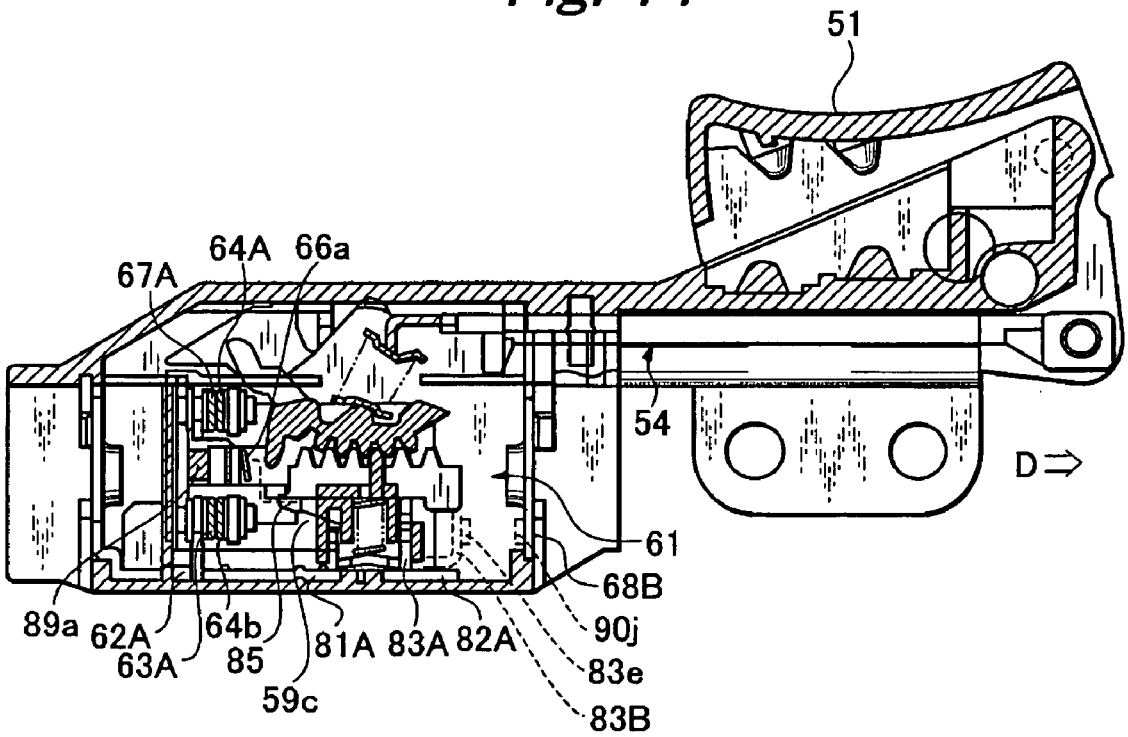
FIG. 14 is a vertically side view showing a state that a sliding plate part is brought into electrical contact by means of an auxiliary contact by further pushing the operation part when the operation part is operated to bring a contact into contact.

In addition, pushing the operation part 51 causes the actuator 61 to further move horizontally with the fixed contacts 67A and 63A being in contact with the movable contacts 64*a* and 64*b*, so that the pressure spring 66*a* is compressed to further strengthen contact pressure between the fixed contacts 67A and 63A and the movable contacts 64*a* and 64*b*, as shown in FIG. 14. At the same time, the first auxiliary contact 83A comes to bridge over the auxiliary contact slide plate part 82A of the first terminal 62A and the auxiliary contact slide plate part 81A of the third terminal 68A to achieve contact therebetween.

Further, the second auxiliary contact 83B not shown comes to bridge over the auxiliary contact slide plate part 82B of the second terminal 62B and the auxiliary contact slide plate part 81B of the third terminal 68A to achieve contact therebetween. The fixed contacts 67A and 63A are in contact with the movable contacts 64*a* and 64*b* at that time. Accordingly, there is no potential between the auxiliary contact slide plate parts 81A and 82A. This causes no arc in the auxiliary contacts, and therefore, no roughness of the contacts to occur.

Figure 15:
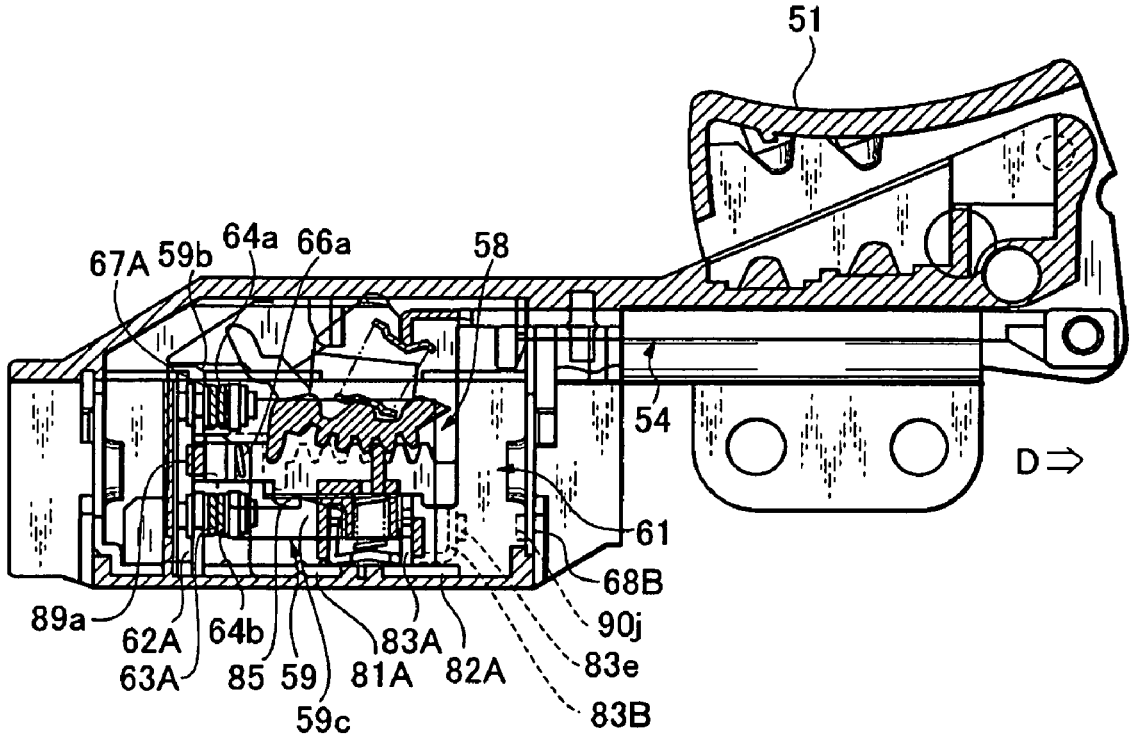
FIG. 15 is a vertically sectional side view showing a state that an operation part is further pushed to lock a stopper with two auxiliary contact sliding plate parts being in contact.

Moreover, in the case of pushing the operation part 51, the auxiliary contact slide plate part 82A is made contact with the auxiliary contact slide plate part 81A by means of the first auxiliary contact 83A (similarly, the auxiliary contact slide plate part 82B is made contact with the auxiliary contact slide plate part 81B by means of the second auxiliary contact 83B not shown), and thereby, the lock part 85 is fitted into the claw part 59C to lock horizontal movement of the actuator 61 in a pressing direction, as shown in FIG. 15. This allows contact between the fixed contacts and the movable contacts to be maintained with urging force of the pressure spring 66*a* being kept constant and locked.

Figure 16:
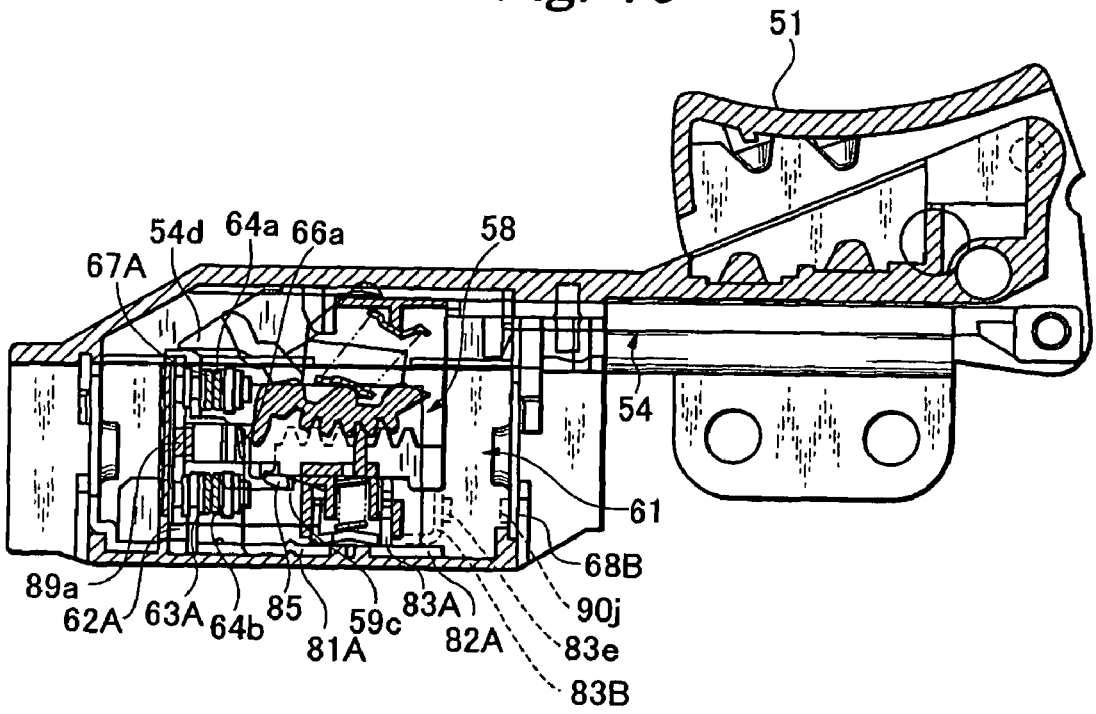
FIG. 16 is a vertically sectional side view showing a full-stroke state of the operation part.

In addition, in the case of pushing the operation part 51 to achieve a full-stroke condition, the actuator 61 moves horizontally to move the claw part 59C and the lock part 85 a little, as shown in FIG. 16. The lock state, however, is kept, the contact state between the fixed contacts 67A and 63A and the movable contacts 64*a* and 64*b* is maintained, and the contact state between the first auxiliary contact 83A and the second auxiliary contact 83B is also held maintained.

Maintaining an on state of the operation part 51 as described above allows a locked state of the fixed contacts 67A and 63A and the movable contacts 64*a* and 64*b* to be maintained and an electric contact state to be maintained under a condition that the first auxiliary contact 83A bridges over the auxiliary contact slide plate parts 81A and 82A (similarly, a condition that the second auxiliary contact 83B bridges over the auxiliary contact slide plate parts 81B and 82B).

When the operation part 51 is moved from the full-stroke condition in which the operation part 51 is pushed to a condition in which a hand is released to go away from the operation part 51, return of the return spring 52 provided in the operation part 51 causes the operation part to be returned to the original state, and thereby, the top end part 54*d* of the plunger 54 moves left in FIG. 15 to push the inclining surface 59*b* of the top of the stopper part 59. This causes the lock part 85 locked in the claw part 59*c* of the stopper part 59 to be released to move so that the contact state of the fixed contacts 67A and 63A and the movable contacts 64*a* and 64*b* would be released in accordance with return force of the pressure springs 66*a* and 66*b* and reverse force of the reverse spring 57. The plunger 54 draws the reverse member 58 to reversibly rotate the reverse member 58 to the original state when the operation part 51 further returns to the original state under the above condition. This causes the fixed contacts 67A and 63A to be separated from the movable contacts.

The first auxiliary contact 83A, however, moves from the electrically contacting state achieved by bridging over the slide plate parts 81A and 82A to the state of no contact in accordance with movement of the actuator 61 before the movable contacts 64*a* and 64*b* separate from the fixed contacts 67A and 63A. Accordingly, no potential between the auxiliary contact slide plate parts 81A and 82A causes an arc in the first auxiliary contact 83A to occur, so that no roughness of the contacts also occurs.

Similarly to the above, the second auxiliary contact 83B also moves from the electrically contacting state achieved by bridging over the slide plate parts 81B and 82B to the state of no contact in accordance with movement of the actuator 61. Accordingly, no potential between the auxiliary contact slide plate parts 81B and 82B causes an arc in the second auxiliary contact 83B to occur.

As described above in a time series, the operation part 51 is operated to make the fixed contacts 67A and 63A contact with the movable contacts 64*a* and 64*b* and make the first auxiliary contact 83A contact with the second auxiliary contact 83B. The connection mechanism of the switch other than addition of the auxiliary movable contact 83*e* to the second auxiliary contact 83B is same as the connection mechanism described in the related art.

Figure 17:
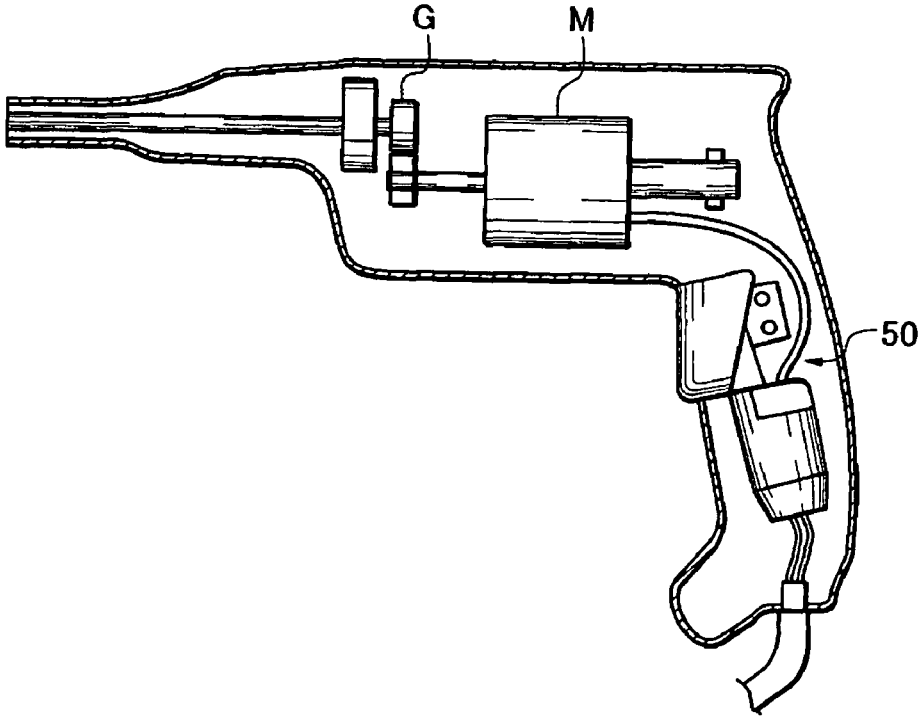
FIG. 17 schematically illustrates an electric tool comprising the trigger switch.
Figure 18:
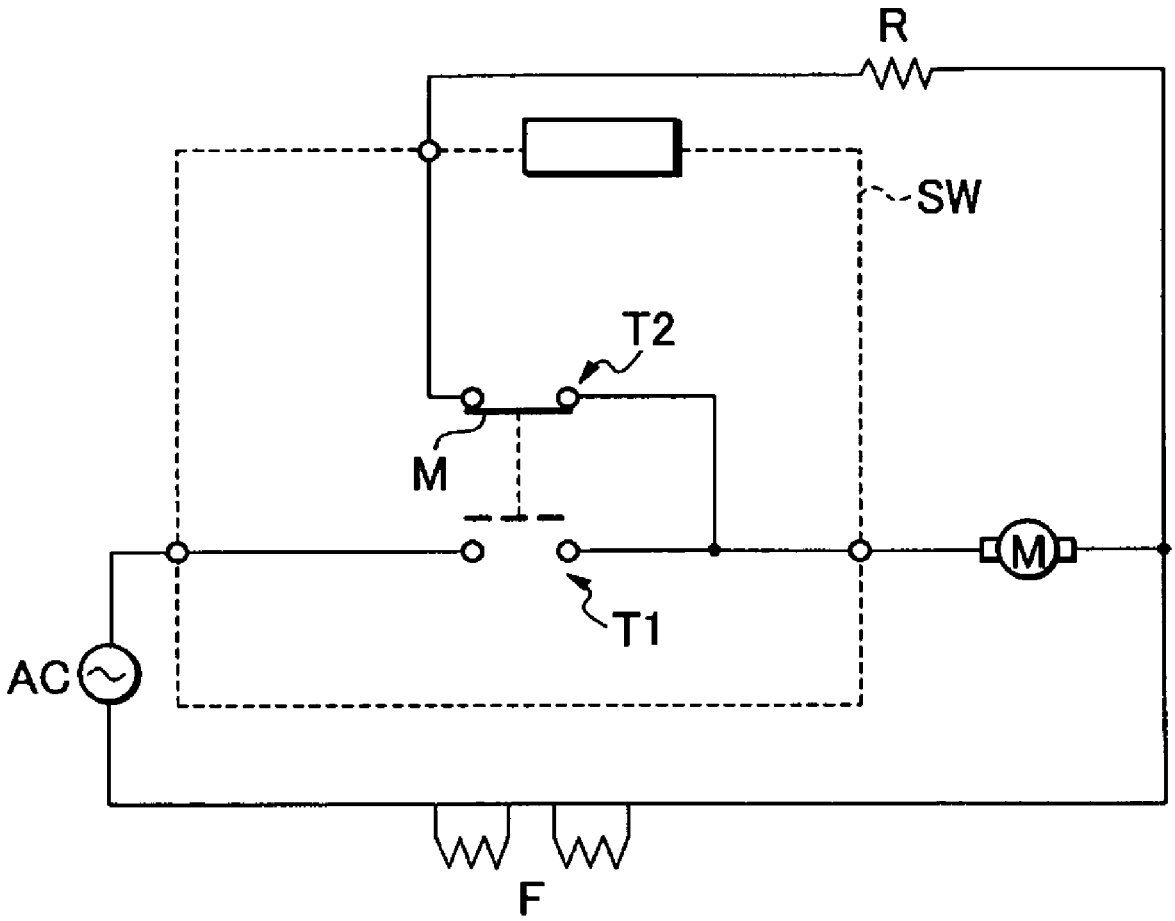
Fig. 18 PRIOR ART
FIG. 18 is a circuit diagram schematically showing a contact condition of a fixed contact, a movable contact and an auxiliary contact, which form a trigger switch in accordance with a conventional technology.

FIG. 17 shows an electric tool comprising the trigger switch 50 in accordance with the invention of the application. The trigger switch 50 is housed at a position held by a hand. The AC voltage is supplied from the outside. Operating the trigger switch 50 allows the motor M to rotate and rotation to be achieved through a transmission gear G.

The invention is useful as a trigger switch mounted to an electric tool, the trigger switch comprising a contact mechanism of a spring reverse type switch suitable for large AC and DC.

What is claimed is:

1. A trigger switch comprising:

fixed contacts forming main contacts double in series and functioning as a switch for supplying a motor with power and slide plate parts connected to the fixed contacts; and movable contacts provided in an actuator interlocking with an operation part and auxiliary contacts sliding on the slide plate parts, wherein the fixed contacts, the movable contacts and the auxiliary contacts are arranged in a manner that:

drawing the operation part causes the actuator to move in a forward direction to make the movable contact come into electric contact with the fixed contact so as to supply the motor with power while simultaneously making the auxiliary contact bridge over the slide plate parts to achieve electric contact so as to make no potential in the contact between the movable contact and the fixed contact, and releasing the operation part causes the actuator to move in a reverse direction to make the movable contact separate from the fixed contact while simultaneously making movement of the auxiliary contact bridging over the slide plate parts cause a break of the contact with the slide plate part and a movable contact provided in the auxiliary contact be in contact with a fixed contact for short-circuiting the motor.

2. A trigger switch in a spring reverse type switch comprising:

a pair of fixed contacts arranged to face in a same direction in a box-like case having an opening surface, the fixed contacts forming main contacts double in series;

a pair of movable contacts coming into contact with and/or going away from the pair of fixed contacts and an actuator having pressure springs for pressuring the pair of movable contacts from a rear side;

a rotatable reverse member for driving the actuator;

a coiled reverse spring having one end connected to the reverse member and the other end engaged with a plunger, the reverse spring having a reverse point; and an operation part for moving the plunger, whereby the operation part is pushed/released to make the pair of movable contacts come into contact with/go away from the pair of fixed contacts to turn on/off the main contacts double in series, wherein the actuator includes a pair of auxiliary contacts, a slide plate part connected to one fixed contact of the pair of fixed contacts and a slide plate part connected to the other fixed contact are provided, and the fixed contacts, the movable contacts and the auxiliary contacts are arranged in a manner that;

reverse movement of the reverse member causes the pair of movable contacts to come into contact with the pair of fixed contacts and simultaneously causes the pair of auxiliary contacts to bridge over the slide plate part connected to one fixed contact of the pair of the fixed contacts and the slide plate part connected to the other fixed contact to achieve electric contact after the actuator is moved by a fixed amount to reduce an interval between the contacts before the reverse point in turning on the main contacts double in series, and releasing restraint of the actuator after the reverse point causes the pair of movable contacts to go away from the pair of fixed contacts, and simultaneously causes the electric contact achieved by the pair of auxiliary contacts bridging over the slide plate part connected to one fixed contact of the pair of fixed contacts and the slide plate part connected to the other fixed contact to be released and causes the motor to be short-circuited by making a movable contact provided in the slide plate part come into contact with a fixed contact provided on an opposite side so as to be faced to the pair of fixed contacts to achieve electric contact after restraint of movement of the actuator before the reverse point in turning off the main contacts double in series.

3. The trigger switch according to claim 2, wherein a pinion is formed in the reverse member and a rack engaged with the pinion is formed in the actuator.

4. The trigger switch according to claim 2, wherein the plunger includes a projection part projecting downward, the reverse member includes a protrusion pressured by the projection part in accordance with a push of the operation part, and pushing down the operation part causes the projection part to pressure the protrusion of the reverse member to make the reverse member rotate against force of the reverse spring and causes the actuator to move to make the movable contact approach the fixed contact.

5. The trigger switch according to claim 2, wherein a surface having a gentle difference in level is formed in a lower surface of the plunger at a top end part thereof, a stopper member having a claw part and constantly contacting with the surface with a difference in level is provided, a stopper spring for urging the stopper member upward is provided, the actuator is provided with a lock part for engaging with the claw part of the stopper member, and movement of the stopper member along the surface with a difference in level of the plunger locks or releases engagement of the claw part of the stopper member with the protrusion of the actuator.

6. The trigger switch according to claim 5, wherein the stopper member is raised in turning on the switch, the lock part of the actuator moves over the claw part of the stopper member to make the movable contact come into contact with the fixed contact, and engagement of the claw part with the lock part of the actuator is locked at the time.

7. The trigger switch according to claim 2, wherein moving the operation part in a direction of switching off to move the plunger over the reverse point of the reverse spring in the locked state does not cause a release state for a period of time due to the shape of the lower surface of the plunger at the top end part, further moving the operation part in a direction of switching off over the reverse point of the reverse spring causes the stopper member to go down due to the lower surface of the plunger at the top end part to make the lock means released, and as a result, the actuator immediately moves and the movable contact is instantaneously separated from the fixed contact to switch off.

* * * * *